US005390933A

United States Patent [19]

Kraus

[11] Patent Number: 5,390,933

[45] Date of Patent: Feb. 21, 1995

[54] BASEBALL GAME APPARATUS

[76] Inventor: Thomas A. Kraus, 1248 Coventry Pl., Palmdale, Calif. 93551

[21] Appl. No.: 163,739

[22] Filed: Dec. 6, 1993

[51] Int. Cl.[6] ..... A63F 3/00

[52] U.S. Cl. ..... 273/244; 273/93 C; 273/141 R

[58] Field of Search ..... 273/93 C, 93 R, 244, 273/141 R

[56] References Cited

U.S. PATENT DOCUMENTS

| | | | |
|---|---|---|---|
| 3,224,773 | 12/1965 | Roed | 273/93 R |
| 3,545,758 | 12/1970 | Payne | 273/141 R |
| 4,261,569 | 4/1981 | Frohlich | 273/93 C |
| 4,822,043 | 4/1989 | Carter | 273/93 C |

OTHER PUBLICATIONS

"Dice Baseball Fever", APBA, Newsweek, Life/Style Section, Aug. 23, 1976.

*Primary Examiner*—Benjamin H. Layno

*Attorney, Agent, or Firm*—Roger A. Marrs

[57] ABSTRACT

A game apparatus is disclosed herein having a board with a baseball field layout providing a track over which player tokens are moved in response to the position of spinners with respect to indicia carried on cards. The cards are insertably carried in holders and the indicia relates to information of existing "at bats" averages and of existing "pitchers" averages. Cards are provided with stolen base and pick-off information as well. A pair of "batter's results" and "pitcher's results" index cards are provided in spaces on the field layout. Tokens are employed for game player representation on the field layout while a game opener "toss" token is used to determine who will commence play and a score card is utilized to keep a score.

6 Claims, 2 Drawing Sheets

BATTER'S RESULTS

1- STRIKEOUT
2- GROUND OUT
3- SINGLE
4- GROUND OUT
5- SACRIFICE
6- DOUBLE
7- GROUND OUT
8- FLY OUT
9- TRIPLE
10- FLY OUT
11- HOME RUN
12- WALK
13- DOUBLE PLAY

31

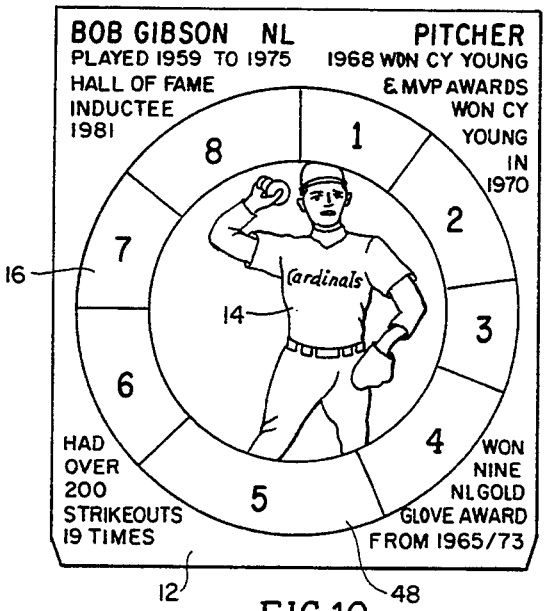
FIG.10.
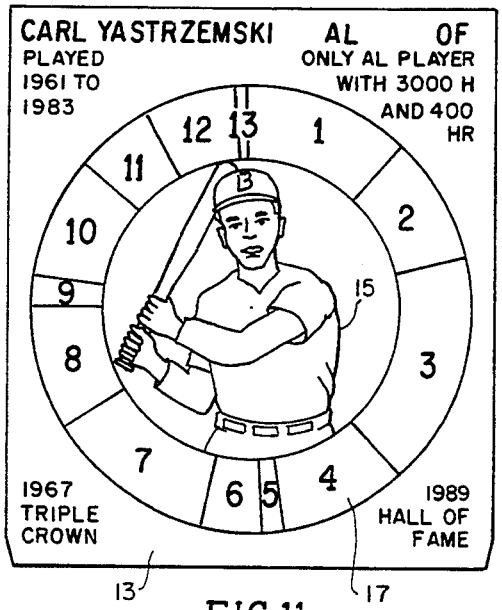
FIG.11.
| PITCHER'S RESULTS |
|---|
| 1-CHANCE FOR BATTER |
| 2-CHANCE FOR BATTER |
| 3-WALK |
| 4-CHANCE FOR BATTER |
| 5-STRIKEOUT |
| 6-CHANCE FOR BATTER |
| 7-CHANCE FOR BATTER |
| 8-CHANCE FOR BATTER |
30
FIG.12.
| BATTER'S RESULTS |
|---|
| 1- STRIKEOUT |
| 2-GROUND OUT |
| 3-SINGLE |
| 4-GROUND OUT |
| 5-SACRIFICE |
| 6-DOUBLE |
| 7-GROUND OUT |
| 8-FLY OUT |
| 9-TRIPLE |
| 10-FLY OUT |
| 11-HOME RUN |
| 12-WALK |
| 13-DOUBLE PLAY |
31
FIG.13.
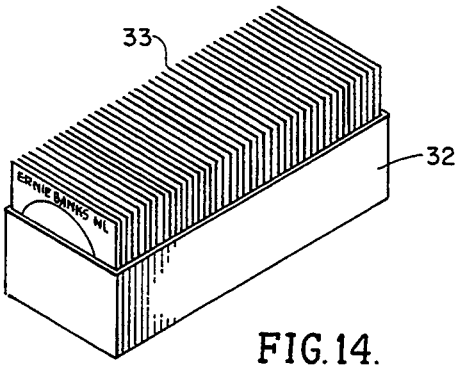
FIG.14.

BASEBALL GAME APPARATUS

BACKGROUND OF THE INVENTION

1. Field of the Invention

The present invention relates to the field of game board apparatus, and more particularly to a novel baseball game wherein a board bears characteristic data of a distinctive baseball field on which player tokens are moved in response to chance determining means which includes a spinner for arbitrarily selecting the length and timing of player moves.

2. Brief Description of the Prior Art

In the past, game boards have been provided which have included courses or paths which are shared by many players as the players position or move tokens indicative of their play in response to some form of chance determining means, such as a spinner, cards, dice, etc. The chance determining means usually indicates the length of move along the path or course and the player first reaching the end of the course is declared the winner. However, such conventional games do not allow for a high degree of player skill to be employed in determining the player's length of move along the path or course in order to reach the terminating end of the path or course with the highest score. Furthermore, inasmuch as the path or course is provided, the outcomes of conventional games do not depend on a "winning" combination of values such as may be provided by employing multiple sources of information, such as percentage of existing baseball batters and pitchers so that the game is played simultaneously with a multiplicity of information based on individual player percentages. Consequently, most conventional games fall short of achieving intellectual stimulation in combination with chance determining means which will allow for a wide variety of games to be played upon a single board.

In many game apparatuses, the game is not specific to a particular sport, such as in the present instance, baseball. By employing batter averages and pitcher averages in connection with a mechanical chance determining means, the player can simulate an actual baseball game. Also, by employing a baseball field layout with tokens adapted to travel from base to base in accordance with the outcome of the chance determining means, simulation of an actual baseball game is realized.

Therefore, a long-standing need has existed to provide a novel baseball game which is realistic in its course of play and which employs information based on actual statistics involving batting averages and pitcher performance on well known and existing players.

SUMMARY OF THE INVENTION

Accordingly, the above problems and difficulties are avoided by the present invention which provides a novel game board having a baseball field layout which includes a single track over which a plurality of player game tokens are moved in response to the outcome of chance determining means. The chance determining means takes the form of at least a pair of holders having a pocket for insertably receiving any one of a variety of batter or pitcher cards respectively and which includes a spinner mechanism manually operated so as to rest at a random position denoting a batting statistic or pitching performance statistic which directs the action or course of play during the game.

Places are set out on the field layout to accommodate pitcher and batter information which relate to the indicia or information on the respective batter and pitcher cards used in connection with the chance determining means.

Therefore, it is among the primary objects of the present invention to provide a novel game board apparatus incorporating a baseball format which may be played simultaneously by several players to effect playing combinations having different values based on batter and pitcher performance statistics.

Another object of the present invention is to provide a novel game board apparatus of the baseball type upon which an individual player moves a token responsive to chance determining means so as to effect a "Winning" combination based on batter and pitcher statistics in combination.

Still another object of the present invention is to provide a novel baseball game board apparatus displaying a plurality of statistical indicia on chance determining cards which are operated in combination with spinners so as to select certain percentage data which is used in moving the player's token from space to space on the field layout.

Yet another object of the present invention is to provide a baseball game board apparatus for playing games in the use of which the outcome of the game is not entirely dependent upon the skill of the respective players in which certain elements of chance are involved in the playing of the game.

A further object of the present invention is to provide a novel baseball game apparatus based on a player's random selection of token moves directly related to existing statistical information on baseball pitchers and batter information and in combination with chance determining means, may be employed to play various highly amusing and interesting games and which, at the same time, involves sufficient player skill to render attention, alertness and resourcefulness a large factor in the playing of the game.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 10 is a front elevational view of a pitcher card showing indicia relating to an actual player's statistics used in the spinner shown in FIG. 3;

FIG. 11 is a view similar to the view of FIG. 10 illustrating a player's batting average information statistic;

FIG. 12 is an instruction card showing pitcher's results used in combination with the card shown in FIG. 10;

FIG. 13 is an information card showing batter's results for use in combination with the batter card shown in FIG. 11; and FIG. 14 illustrates a holder for carrying a plurality of the pitcher and/or batter cards shown in FIGS. 10 and 11.

DESCRIPTION OF THE PREFERRED EMBODIMENT

Figure 1:
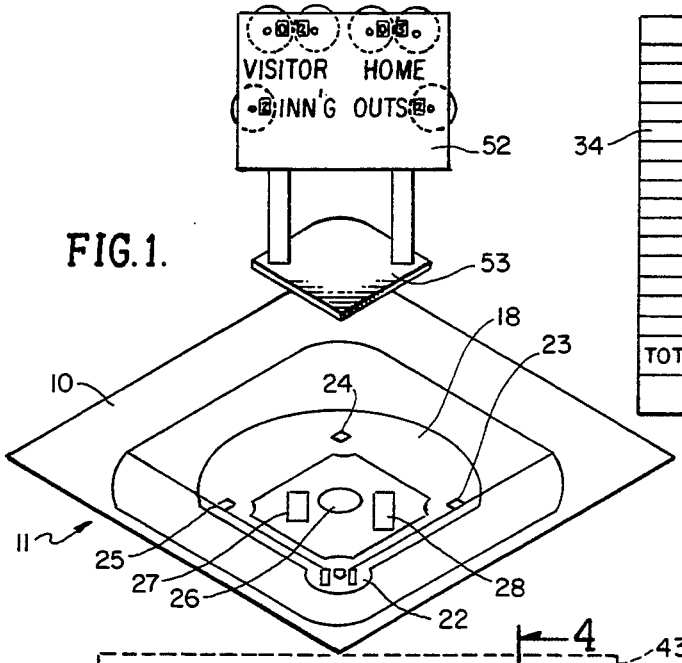
FIG. 1 is a front perspective view showing the game board layout for the present apparatus invention.

The inventive game apparatus is a baseball board game utilizing game board 10 as illustrated in the general direction of arrow 11. The game is based on professional baseball utilizing its rules and its players from both past and present by analyzing and using past performance statistics for the operation of play. The novel game apparatus is unique in that the game is played with cards 12 and 13, as shown in FIGS. 10 and 11 respectively. On the front of the card is a likeness, such as a photograph, team colors, etc. of a player 14 with respect to pitchers and player 15 with respect to batters. Each of the pictorial representations or graphic subject matter is surrounded by a circular band having a plurality of segments indicating actual lifetime statistics. The statistics are represented on a value scale from one to eight with respect to the pitcher card and on a scale of one to thirteen on the batter scale. It is these values on the various segments which will determine the outcome of each player's turn at bat. The baseball player's name, league, position and career highlights are also placed on the front of the card.

Figure 7:
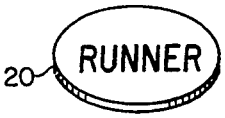
FIG. 7 is a perspective view of a runner token.
Figure 8:
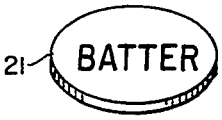
FIG. 8 is a perspective view of a batter token.

In the employment of the game board 10, a playing track 18 is employed on the surface thereof over which a runner token 20 may be used, as shown in FIG. 7. FIG. 8 shows a batter token 21 which may be placed on a home base 22 on the playing track 18 while first, second and third bases are also carried on the playing track and identified by numerals 23, 24 and 25 respectively. A pitcher's mound 26 separates an area 27 from a second area 28. These areas are spaces in which pitcher result card 30 is placed. The pitcher's result card 30 is shown in FIG. 12 and a batter's result card 31, as shown in FIG. 13, is placed on the space 28.

A multiplicity of pitcher cards and batter cards may be stored in a box, such as indicated by numeral 32 as shown in FIG. 14. The plurality of pitcher cards are illustrated in the box collectively by numeral 33 and a portion of each card projects from the box so that it is easily identified and may be readily grasped by the fingers and pulled out of the stack at the selection of the game player.

Figure 9:
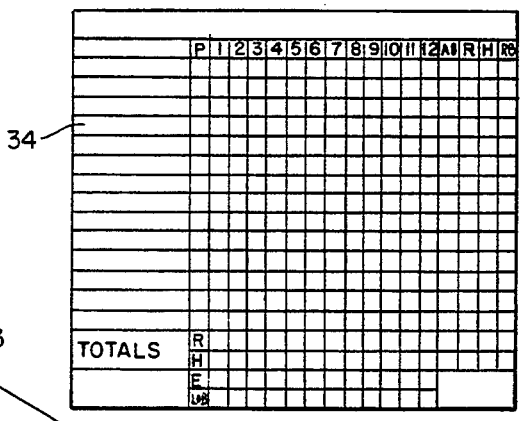
FIG. 9 is a front view of a score sheet.

A score card is shown in FIG. 9 as represented by numeral 34 wherein the game player may place in the name of the pitcher or batter being represented, as shown on the cards 12 and 13, and the score of the game is kept in the respective boxes adjacent to the name. Totals are identified at the bottom of the score card 34 and may be compared by all the game players at the end of play.

Figure 5:
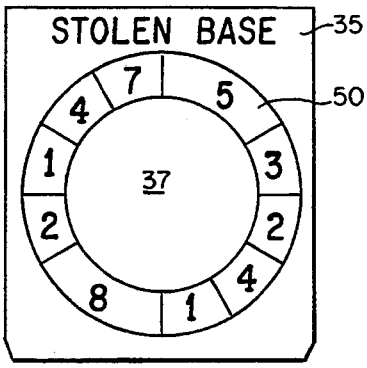
FIG. 5 is a front elevational view of a stolen base card.
Figure 6:
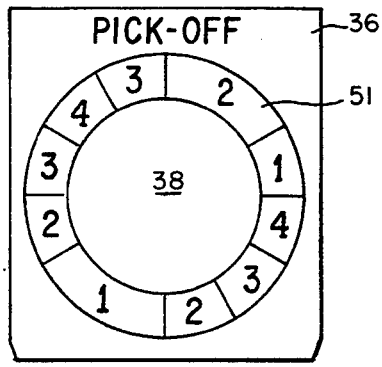
FIG. 6 is a front elevational view of a pick-off card.

A pair of cards similar to the cards shown and representing pitchers and batters is illustrated in FIGS. 5 and 6 by numerals 35 and 36 which represent stolen bases and pick-off statistics for selected players. The two cards have graphic representation placed in the central area, such as identified by numerals 37 and 38 respectively and wherein these areas are surrounded by a circular band having segments dividing the band into given proportions equivalent to the actual stolen base and pick-off statistics of known players. Again, the segments include indicia such as numerals which represent values introduced into the game according to the rules of play. The values will either affect the player movement token in a positive or a negative manner depending on the value determined. The determination is similar to the determination of value on the pitcher and batter cards in that the stolen base and pick-off cards are introduced into the holder 14 having a transparent side for viewing of the values.

Figure 3:
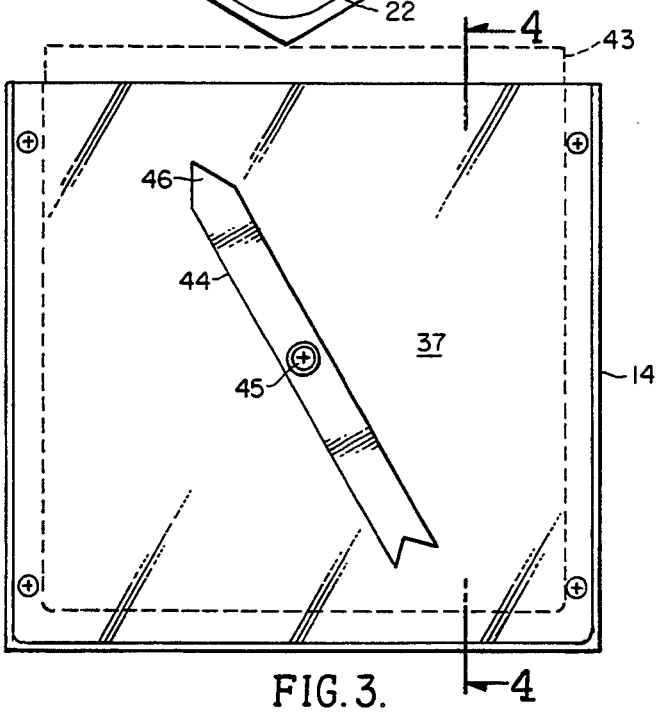
FIG. 3 is a front elevational view of a spinner type chance determining means employed in the game shown in FIG. 1.
Figure 4:
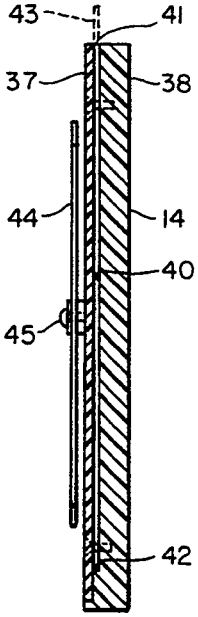
FIG. 4 is a transverse cross-sectional view of the chance determining means shown in FIG. 3 as taken in the direction of arrows 4—4 thereof.

Referring now in detail to FIGS. 3 and 4, the holder 14 is illustrated having a transparent or translucent side 37 that is carried on a solid backing 38. The backing is undercut to provide a cavity 40 with an entrance 41 at the top of the holder. A game player Will select one of the cards and introduce the card through the slotted entrance 41 into the cavity 40. The cavity is of a length shorter than the height of the card so that the bottom of the card will rest on a stop or ledge 42 while a portion 43 of the card will remain exposed out of the top of the holder. The card is illustrated in broken lines in FIGS. 3 and 4. In order to select a value carried on a segment Of the circular band regardless of the card which is within the holder, a rotatable spinner 44 is employed having a loose mounting pin 45 rotatably carrying the spinner on the backing 38. The rotatable fastener 45 passes through the center of the translucent or transparent panel 37 so that when a pointer 46 of the spinner 45 stops at a particular segment carried on the card, the value of the segment is visually observed by the game player and entered into the score card. Either the token 20 or 21 is activated depending on the outcome of the value and the card in the holder.

Figure 2:
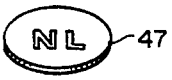
FIG. 2 is a perspective view of a token employed for selecting the first to play in the course of the game.

At the start of each game, a start token 47, as shown in FIG. 2, may be tossed or flipped by the game player in order to decide what team or what player will go first. An at bat token 21 is placed on the home base 22 at the start of the game while a runner or runner token 20 is placed on the game board in accordance with the selected values. The variety of cards 12, 13, 35 and 36 are selectively placed within the holder and the spinner is spun to indicate a selected value taken from a segment in order to determine the movement of tokens about the board. It is to be noted that the numerical value information carried on cards 30 and 31 represents the values carried on the cards 12 and 13 in the segments of the circular bands. Therefore, not only do the values become selected during the course of play for token movement but the movement is identified by the type of play in progress. For example, numeral 5 indicates strike out on card 30 in FIG. 12 and since it is related to the pitcher's results, the same value is indicated in a segment identified by numeral 48 on card 12.

It should be understood that 100% of the information of existing player at bats during his career is shown in the segmented spaces in the circular bands about the graphic representation of the player himself. The statistics associated with card 12 represent pitcher's chances for every batter he has faced in the past. Statistical information for batters is shown on card 13 and is related to the "at bats" of the player's career represented on a particular card.

The stolen base and pick-off cards 35 and 36 respectively are of the same size as the batter and pitcher cards so that these cards will fit into the holder 14. The numbered segmented circles 50 and 51 on the cards are coaxial with the spinner pivot whereby the pointer 44 of the spinner will come to rest on a given segment at the conclusion of a spin.

It is noted that the board 11 includes a simulated scoreboard 52 for displaying various results of actions taken or gained during the course of play. Scoreboard 52 includes a base 53 for supporting the scoreboard in a raised upright position. The score sheet 34 tracks the individual player results throughout the play of the game.

BASEBALL GAME RULES

The following describes a typical set of rules and instructions for playing a game using the apparatus of the present invention.

To commence play, the apparatus comprises:

One set of rules, one game board, one scoreboard base, two scoreboard supports, 20 score sheets, one N.L./A.L. coin, one batter token, three runner tokens, two spinners/card sleeves, one stolen base card, one pick-off card, and 72 game cards of the greatest players in the history of baseball.

The object is the same as in Major League Baseball which is to score more runs than your opponent in a nine inning baseball game. If the home team is winning after 8½ innings, they do not bat in the bottom of the ninth, they are the winners. If home team is losing after 8½ innings, they get another chance to bat. If the home team then outscores the visitors' team, they are the winners, if the home team fails to tie or go ahead of the visitors' team, they lose. In case of a tie at the end of nine innings, continue into extra innings until you have a winner in the same way as described above.

Play any type of baseball game you wish. Have the American League play the National League as in a normal Major League All-Star game, or have the older players against the newer ones, or mix'em and match'em, it's all up to you! Pick Cy Young to pitch to Yogi Berra, or have Babe Ruth and; Hank Aaron in the same outfield!

All the value or chance determining cards are based on the actual player's statistics compiled by him in his Major League Baseball career.

Players who have played in both the American and National Leagues are representing the league in which they played the most games.

Players who have played more than one position in their career are designated to play the position they played the most games at. (If a player played 2 or 3 positions very often in his career, and the games played at one position are within 300 games of another position, both are designated. Example: Ernine Banks, in his career, played 1,259 games at first base, and played 1,125 games at shortstop. These are close enough, so he is designated to play either position).

STARTING THE GAME

Separate cards into 8 piles. There will be one pile for each position: pitchers, catchers, first basemen, second basemen, shortstops, third basemen and outfielders. There will also be another pile for multi-position players as described before. (example: Rod Carew can play second base or first base, Harmon Killebrew can play third base or first base).

Using the coin 47, determine which person will be the home team and which person/will be the visiting team. The visiting team will bat first, as in Major League Baseball rules, and they will also have the opportunity to pick the first player in the "draft".

THE DRAFT

The person who is "managing" the visitors' team picks first and selects one player from any of the 8 piles laid out previously. Next, the home team "manager" picks any remaining player from any of the 8 piles.

Alternate picks in this manner until each team consists of: one pitcher, one catcher, one first baseman, one second baseman, one shortstop, one third baseman and three outfielders. When this is completed, there will be one more round. Select one more player from any pile of the remaining position players, (non-pitcher), to be your designated hitter.

THE LINE UP

Make up your batting order and enter it on the score sheets 34 provided. Each team places their cards 13 in a pile in the order in which you want them to bat. Your 9th batter will be on the bottom and your first batter, or lead off batter will be on top. Your pitcher will be off to the side.

THE GAME

The home team places its pitcher card 12 in one of the spinner holders 14. The visitors' team places its first batter card 13 in the other spinner holder. Lay the spinner holders on a flat solid surface for best results.

The home team spins the spinner 44, acting as a chance determining means, for its pitcher and reads the results, (strikeout, walk or chance). The pitcher takes precedence. If pitcher spins a walk, batter goes to first base with token 21. If pitcher spins a strikeout, batter is out. If pitcher spins a chance, batter gets a chance to spin, then read the results on the batter's card and follow the instructions. For example:

1) Home team spins for Tom Seaver, result is a walk. Visitors' first batter, Willie Mays, goes to first base.
2) Home team spins for Jim Palmer, result is a strikeout. Visitors' first batter, Ty Cobb, is out and second batter is up.
3) Home team spins for Walter Johnson, result is a chance. Visitors' first batter, Mickey Mantle, gets a chance to spin. Result is a double, place a runner token on second base to represent Mantle's double.

When a batter is done, record the results on the score sheet 34, next to his name, remove his card from the spinner sleeve or holder and place the card on the bottom of his team's batting order pile. Take the player card on top and put this card in the holder. Continue in this manner, "pitching" and "hitting" to each other until three outs are recorded. That was the end of the top half of the first inning. Now, the visiting team gets to "pitch" to the home team, in the same manner as above until three outs are recorded. That was the end of the bottom half of the first inning. Next is the top half of the second inning, home team "pitches" again and visits "bat", and so on. Continue as in Major League Baseball rules, for nine innings. If score is tied continue. Remember, home team bats last and gets a chance to tie, or win, if they are losing after the top half of the ninth inning or any "extra" innings.

Stolen base cards 35 and pick-off cards 36 are used in the same manner as described for the other player pitcher and batter cards.

1) Substitutions may be made, only two per player, per game. Just trade a player in your batting order for any player left in the draft pile and insert the new player in the same spot in the order. With the exception of a designated hitter, the new player must play the same position as the old one. (Example: You would like to substitute Stan Musial for Pete Rose, Rose bats in the #1 spot in the batting order. Remove Rose, from the pile and set him aside, get Musial from the draft pile and place him in the #1 spot in the batting order). Any player removed from the game may not return to that game for any reason.
2) Another type of substitution can be made. A player may be moved to another position to remain in the game, but he must be a multi-position player. (Example: You have Harmon Killebrew, (3B–1B), playing first base and Brooks Robinson playing third base and you want to bring in Jimmy Foxx to play first base. Killebrew can be moved from first base to third base and you may select Foxx from the draft pile. Robinson is now out of the game and may not return. Killebrew bats in his same spot in the batting order and Foxx bats where Robinson was.
3) If the spinner lands on a line between two results, do not take too much time to study it, spin again and be fair for both teams.
4) Obviously, if a spin results in a sacrifice or a double play with no runner on base, ignore the advance of a runner or a second out. Treat those as a fly out or a ground out.
5) A runner or runners may only advance as many bases as the batter gets. (Example: Runner on second base, batter singles (1 base), runner goes to third (1 base).
6) The batting team may use the stolen base card and the pitching team may use the pick off card 36 once per inning. You must state which runner you are attempting to steal or pick off 36 before spinning whichever card you choose. There are no double steals and there is no stealing of home.

The instruction cards 30 and 31 are followed by the game players to advance or retard token movement accordingly.

| PITCHERS RESULTS ON CARD 31 | |
|---|---|
| 1 = Chance for batter | Batter spins, follow instructions below. |
| 2 = Chance for batter | Batter spins, follow instructions below. |
| 3 = Walk | Batter goes to first base |
| 4 = Chance for batter | Batter spins, follow instructions below. |
| 5 = Strikeout | Batter is out |
| 6 = Chance for batter | Batter spins, follow instructions below. |
| 7 = Chance for batter | Batter spins, follow instructions below. |
| 8 = Chance for batter | Batter spins, follow instructions below. |

| BATTERS RESULTS ON CARD 30 | |
|---|---|
| 1 = Strikeout | Batter is out |
| 2 = Ground Out | Batter is out |
| 3 = Single | Batter goes to first base, runners move up 1 base |
| 4 = Ground Out | Batter is out |

-continued

| BATTERS RESULTS ON CARD 30 | |
|---|---|
| 5 = Sacrifice | Batter is out, lead runner moves up 1 base |
| 6 = Double | Batter goes to second base, runners move up 2 bases |
| 7 = Ground Out | Batter is out |
| 8 = Fly Out | Batter is out |
| 9 = Triple | Batter goes to third base |
| 10 = Fly Out | Batter is out |
| 11 = Home Run | Batter and all runners circle the bases |
| 12 = Walk | Batter goes to first |
| 13 = Double Play | The 2 lead runners, or, if only one man on base, then he and the batter are both out. |

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A game apparatus comprising:

a game board having a flat planar surface displaying a continuous track representing baseball bases;

player tokens movably carried on said game board adapted to be selectively moved about said baseball bases;

chance determining means operable by the players for selecting values of player moves about said playing track baseball bases;

said chance determining means includes a first card stack comprising a plurality of pitcher cards, each pitcher card representing the lifetime pitching statistics of an actual baseball player, said pitching statistics on each pitcher card comprising a plurality of different indicia wherein each different indicia corresponding to a different pitching result, the particular indicia and the i number of different indicia to be placed on each of said pitching cards being predetermined and non-random in order to,correspond to the lifetime pitching statistics of the respective baseball player;

a second card stack comprising a plurality of batter cards, each batter card representing the lifetime batting statistics of an actual baseball player, said batting statistics on each batter card comprising a plurality of different indicia wherein each different indicia corresponding to a different batting result, the particular indicia and the number of different indicia to be placed on each of said batting cards being predetermined and non-random in order to correspond to the lifetime batting statistics of the respective baseball player;

a holder having an open cavity for insertably receiving selected ones of said pitcher cards and said batter cards;

said holder having a spinner operable in cooperation with said card indicia to select said player token move on said playing track;

said chance determining means further includes a stolen base card and a pick-off card adapted to be inserted in said holder cavity;

said stolen base card and said pick-off card having a segmented band with indicia of different values on each segment representative of known player statistics;

said holder includes a transparent panel exposing said indicia carried on selected ones of said cards;

a pair of spaces carried on said game board surrounded by said playing track;

a pitcher's results card and a batter's results card carried on each of said spaces on said game board; and said pitcher results card and said batter's results card include indicia corresponding to said indicia displayed on said pitcher cards and said batter cards, respectively, said pitcher's result card and said batter's result card occupying said holder cavity for advancing or retarding movement of said player's token along said playing track.

2. The invention as defined in claim 1 including:

a storage box for holding said pitcher cards and said batter cards.

3. The invention as defined in claim 2 including:

a score display having a base carried on said game board.

4. The invention as defined in claim 3 wherein:

said player's token is selected from a pair of tokens identified as a runner token or a batter token.

5. The invention as defined in claim 4 including:

a start-of-game determining device for selecting in initial start of play for a particular player.

6. The invention as defined in claim 5 including:

a score sheet having spaces for entering data corresponding with individual player results during the course of play.

* * * * *